United States Patent [19]

Haavik

[11] 4,422,832

[45] Dec. 27, 1983

[54] LIQUID RING PUMP WITH VANES IN LIQUID RING

[75] Inventor: Harold K. Haavik, South Norwalk, Conn.

[73] Assignee: The Nash Engineering Company, Norwalk, Conn.

[21] Appl. No.: 314,388

[22] Filed: Oct. 23, 1981

[51] Int. Cl.[3] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,320,216 | 10/1919 | Fisher . | |
| 1,844,436 | 2/1932 | Nash . | |
| 1,924,421 | 8/1933 | Stauber | 60/12 |
| 2,416,538 | 2/1947 | Nelson | 230/79 |
| 3,395,854 | 8/1968 | Martin et al. | 230/75 |
| 4,074,954 | 2/1978 | Roberts | 418/68 |

FOREIGN PATENT DOCUMENTS

| | | |
|---|---|---|
| 358628 | 9/1918 | Fed. Rep. of Germany . |
| 465356 | 7/1927 | Fed. Rep. of Germany . |
| 662514 | 7/1935 | Fed. Rep. of Germany . |
| 1911544 | 12/1970 | Fed. Rep. of Germany . |
| 324286 | 1/1930 | United Kingdom . |
| 372086 | 5/1932 | United Kingdom . |
| 2078857A | 1/1982 | United Kingdom . |
| 511423 | 8/1976 | U.S.S.R. . |

*Primary Examiner*—Edward K. Look

*Attorney, Agent, or Firm*—Robert R. Jackson; David W. Plant

[57] ABSTRACT

A liquid ring pump having at least one vane disposed in the portion of the liquid ring between the outer periphery of the rotor and the inner periphery of the housing for controlling the flow of the adjacent liquid to reduce energy losses due to such factors as the curvature of the liquid flow and re-entry of the liquid into the rotor with velocity which does not match the velocity of the liquid already in the rotor.

15 Claims, 11 Drawing Figures

LIQUID RING PUMP WITH VANES IN LIQUID RING

BACKGROUND OF THE INVENTION

This invention relates to liquid ring pumps, and more particularly to liquid ring pumps with flow control vanes in the liquid ring of the pump.

Liquid ring pumps typically include an annular housing and a rotor rotatably mounted in the housing so that the rotor is eccentric to at least a portion of the housing. The rotor has a plurality of radially outwardly extending blades. A quantity of pumping liquid (e.g., water) is maintained in the housing so that when the rotor rotates, the rotor blades engage the liquid and form it into an annular ring around the inner periphery of the housing. Because of the eccentricity of the rotor relative to the housing, the amount of space between any two adjacent rotor blades which is occupied by ring liquid varies cyclically as the rotor rotates. The remaining space between adjacent rotor blades therefore forms pumping chambers which alternately expand and contract as the rotor rotates. The expanding pumping chambers are connected to a source of gas, vapor, or gas-vapor mixture (all of which are hereinafter referred to generically as gas) to be pumped, thereby drawing the gas into what is called the intake zone of the pump. The contracting pumping chambers are similarly connected to the desired sink of the pumped gas, thereby allowing the pump to discharge the pumped gas to that sink from what is called the compression zone of the pump.

In the portion or portions of the liquid ring in which the outer periphery of the rotor is relatively remote from the inner periphery of the housing (sometimes referred to herein as the sweep or sweeps of the pump), the immediate influence of the rotor on the liquid is relatively small. (As used herein and in the appended claims, the term "outer periphery of the rotor" or the like refers to the surface of revolution defined by the outer tips of the rotor blades as the rotor rotates about its axis). In the sweep of the pump the liquid must effect a turn which constitutes a substantial change in direction and must then begin to re-enter the rotor guided only by the inner periphery of the housing. In making this turn, considerable kinetic energy of the liquid may be lost due to such effects as the turbulent mixing of the low velocity liquid near the housing wall and the higher velocity liquid closer to the rotor. These energy losses are sometimes referred to for convenience herein as turning losses. The kinetic liquid energy lost in this way decreases the efficiency of the pump because the lost energy is not available either to perform the work of compressing the gas being pumped or for recovery as mechanical energy through momentum exchange with the rotor when the liquid re-enters the rotor.

Another source of inefficiency in pumps of the type described above is the fact that the velocity vector of the liquid re-entering the rotor typically is not optimal for efficient rotor re-entry. Depending on the angular location of re-entry, either the magnitude, or the direction, or both the magnitude and direction of the velocity vector of the re-entering liquid may differ substantially from the corresponding characteristics of the velocity vector of the liquid already entrained by the rotor. Substantial energy may be lost due to the shock associated with the nearly instantaneous acceleration or deceleration of the liquid re-entering the rotor as it is entrained by the rotor. These energy losses are sometimes referred to for convenience herein as shock losses.

In view of the foregoing, it is an object of this invention to provide improved liquid ring pumps.

It is another object of this invention to provide liquid ring pumps in which turning losses and/or shock losses are reduced to increase the efficiency of the pumps.

It is still another object of this invention to provide means for controlling the flow of pumping liquid in the sweeps of liquid ring pumps to improve and/or control the performance characteristics and/or efficiency of the pumps.

SUMMARY OF THE INVENTION

These and other objects of the invention are accomplished in accordance with the principles of the invention by providing liquid ring pumps having one or more vanes in the portion or portions of the liquid ring between the outer periphery of the rotor and the inner periphery of the housing for guiding, directing, or otherwise controlling the flow of ring liquid outside the rotor. These vanes are mounted relative to the housing so that the major surfaces of each vane are substantially parallel to the rotor axis, and so that at least a substantial part of the portion of the liquid ring outside the outer periphery of the rotor passes on each side of each vane. The vanes may be either approximately concentric with the adjacent portion of the inner periphery of the pump housing, or they may form angles with that portion of the housing periphery or with the outer periphery of the rotor. The angle of one or more of the vanes relative to the housing periphery or the rotor periphery may be variable, for example, by mounting each vane whose angle is to be varied on a rotatable shaft substantially parallel to the rotor axis. One or more vanes may be located in the portion or portions of the liquid ring exiting from the rotor. One or more vanes may be located in the portion or portions of the liquid ring making the transition from exiting the rotor to re-entering the rotor. One or more vanes may be located in the portion or portions of the liquid ring re-entering the rotor. Or vanes may be located in any combination of the foregoing portions of the liquid ring.

Further features of the invention, its nature and various advantages will be more apparent from the accompanying drawing and the following detailed description of the invention.

DETAILED DESCRIPTION OF THE INVENTION

In principle, liquid ring pumps can be constructed with any number of intake and compression zones spaced alternately around the pump in the direction of rotor rotation. The main application of this invention, however, is to liquid ring pumps having only a relatively small number of such intake and compression zones, preferably no more than two intake zones interspersed with two compression zones, and most preferably only a single intake zone and a single compression zone. Generally, if more than the preferred number of intake and compression zones is present, the liquid is so highly controlled by the housing periphery that the vanes of this invention add relatively little to control of the liquid. Although the invention is thus applicable to liquid ring pumps having more than one intake zone and one compression zone, the invention will be clearly understood from an explanation of its application to a pump having only one intake zone and one compression zone. Similarly, although the invention is applicable to pumps having a wide variety of configurations, such as pumps with flat, conical, or cylindrical port members, the invention will be clearly understood from an explanation of its application to one illustrative pump configuration.

Figure 2:
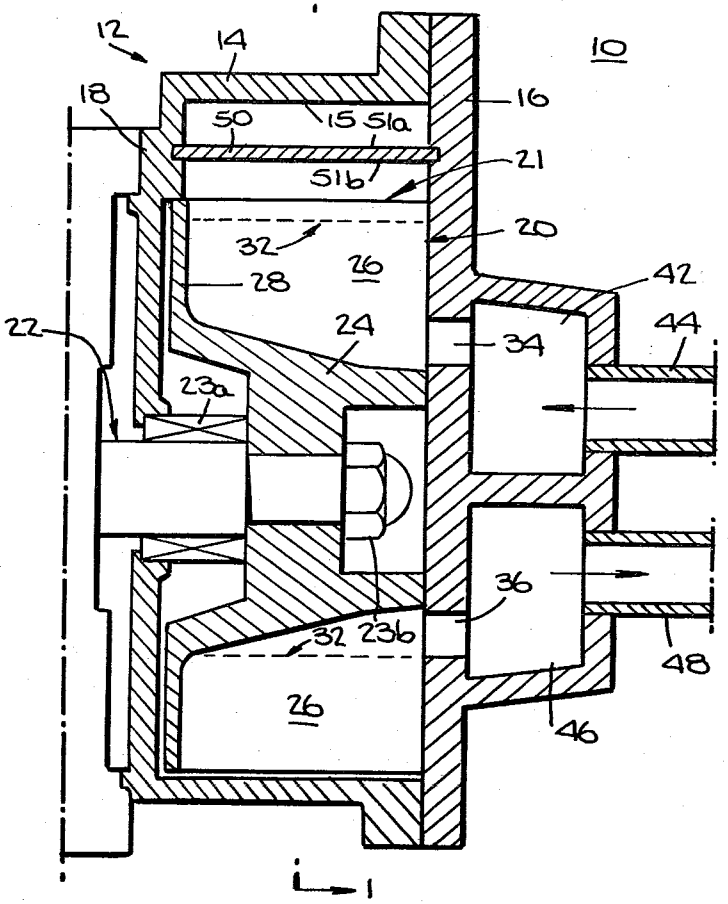
FIG. 2 is a sectional view of the pump of FIG. 1 taken along the line 2—2 in FIG. 1.
Figure 1:
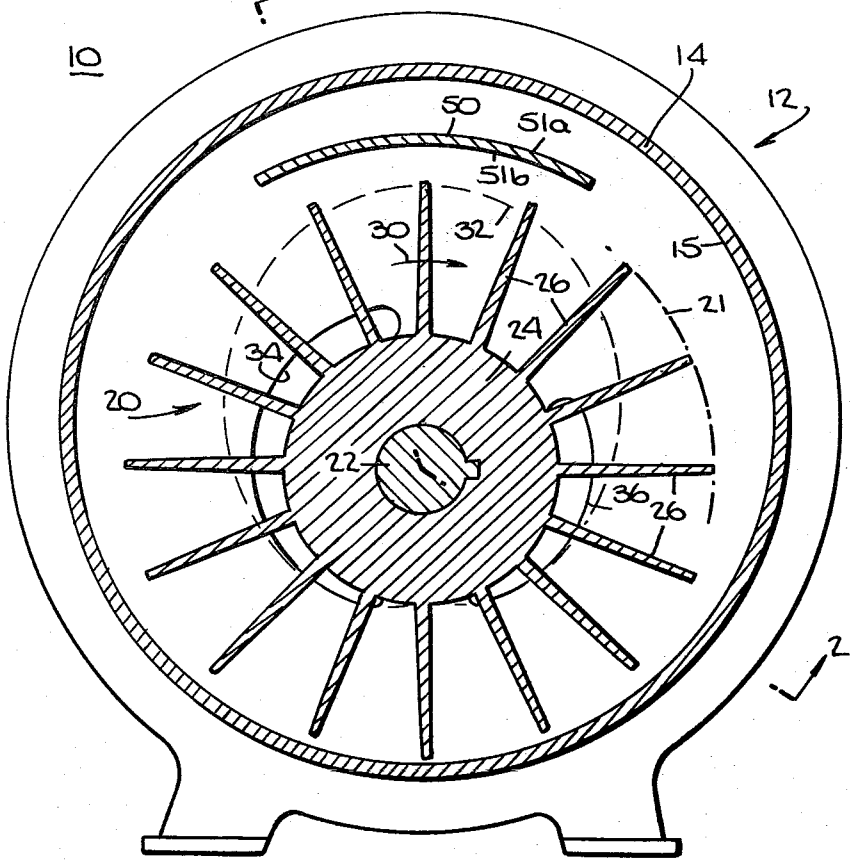
FIG. 1 is a simplified elevational sectional view of a liquid ring pump constructed in accordance with the principles of this invention. The view of FIG. 1 is taken along the line 1—1 in FIG. 2.

As shown in FIGS. 1 and 2, illustrative liquid ring pump 10 includes stationary housing 12 having annular peripheral wall 14 extending between parallel, spaced, front and rear plates 16 and 18, respectively. Rotor 20 is rotatably mounted in housing 12 by means of drive shaft 22 which extends through rear plate 18 to suitable drive means (not shown) such as an electric motor. Annular face seal 23*a* is provided between shaft 22 and rear plate 18.

Rotor 20 includes an annular hub 24 connected to drive shaft 22, a plurality of blades 26 extending radially outward from the hub in planes substantially parallel to the axis of drive shaft 22, and a disc-like rear shroud 28 also extending radially outward from the hub in a plane substantially perpendicular to the axis of drive shaft 22 so as to connect the rear portions of all of blades 26. Rotor 20 is held on shaft 22 by rotor locking nut 23*b*. Rotor 20 is located eccentrically in housing 12 so that the outer periphery 21 of the rotor is much closer to the inner periphery 15 of annular housing wall 14 near the bottom of the pump than it is at the top of the pump. Although blades 26 are shown straight in FIGS. 1 and 2, blades 26 could alternatively be curved or hooked either forward or backward relative to the direction of rotor rotation in the manner known to those skilled in the art.

A quantity of pumping liquid is maintained in housing 12 so that when rotor 20 is rotated as indicated by the arrow 30 in FIG. 1, rotor blades 26 engage the pumping liquid and form it into a circulating annular ring around the inner periphery 15 of annular housing wall 14. The inner boundary or surface of this liquid ring is represented in FIGS. 1 and 2 by the dashed lines 32.

As is best seen in FIG. 1, because rotor 20 is mounted eccentrically relative to housing wall 14, and hence is also eccentric to the liquid ring, rotor blades 26 extend much farther into the liquid ring near the bottom of the pump than they do near the top of the pump. On the left-hand side of the pump as viewed in FIG. 1, the inner surface 32 of the liquid ring gradually diverges from rotor hub 24 in the direction of rotor rotation. Accordingly, in that portion of the pump (known as the intake zone) the spaces bounded by adjacent rotor blades 26, rotor hub 24, and the inner surface 32 of the liquid ring gradually increase in volume in the direction of rotor rotation. On the right-hand side of the pump as viewed in FIG. 1, the inner surface 32 of the liquid ring gradually converges toward rotor hub 24 in the direction of rotor rotation. Accordingly, in that portion of the pump (known as the compression zone) the spaces bounded by adjacent rotor blades 26, rotor hub 24, and the inner surface 32 of the liquid ring gradually decrease in volume in the direction of rotor rotation.

Gas to be pumped is admitted to the intake zone of the pump via intake port 34 in front or port plate 16. The gas is supplied to the pump via intake conduit 44 and intake plenum 42. Compressed gas is discharged from the compression zone of the pump via discharge port 36 in front or port plate 16. The compressed gas is conveyed from the pump via discharge plenum 46 and discharge conduit 48.

The features of the pump described thus far are all known to those skilled in the art, and all of the embodiments shown in the several Figures include the same or similar features.

A source of energy loss, and therefore inefficiency, in pumps of the type described above is the high degree of turbulence which typically occurs in the portion of the liquid ring which is between the outer periphery 21 of rotor 20 and the inner periphery 15 of annular wall 14, especially in the portion of the liquid ring near the top of the pump where rotor periphery 21 is most distant from housing periphery 15 (i.e., in the so-called sweep of the pump). This turbulence is due to many factors, including the loss of contact of a large portion of the liquid ring with the rotor. Particularly in the sweep of the pump, the major portion of the liquid ring is not directly engaged by the rotor. This lack of engagement of the liquid by the rotor permits increased mixing of the lower velocity liquid, which would otherwise remain near the stationary periphery 15 of the housing, with the higher velocity liquid, which would otherwise remain closer to rotor 20. The fact that the liquid must change direction or turn in order to follow the curved inner periphery 15 of the housing greatly increases this turbulence. The high momentum of the high velocity liquid drives it toward curving periphery 15, thereby contributing substantially to the turbulence of the liquid and to the mixing of high and low velocity liquid.

The turbulence described above typically results in a substantial loss of kinetic energy in the liquid, i.e., so-called turning losses. The energy thus lost is not available for compressing the gas being pumped, nor is it recoverable as mechanical energy through momentum exchange with the rotor when the liquid re-enters the rotor in the compression zone of the pump. The lost energy must therefore be made up from the power supplied to the pump. As a result of the turning losses, at least some of the liquid re-entering the rotor in the compression zone of the pump must be accelerated to a greater degree than would be necessary if there were no turning losses. Because such acceleration of the liquid is typically accompanied by other energy losses (i.e., so-called shock losses), the turning losses also have the effect of increasing these other energy losses as well.

In accordance with one embodiment of the present invention, turning losses are reduced by providing vane 50 in the sweep of the pump as shown in FIGS. 1 and 2. Although the exact location and extent of vane 50 may vary as discussed in detail below, in the particular embodiment shown in FIGS. 1 and 2, vane 50 is approximately concentric with the adjacent portion of the inner periphery 15 of the housing and is located approximately midway between that portion of periphery 15 and the adjacent portion of rotor periphery 21. Accordingly, approximately half the portion of the liquid ring outside the rotor periphery passes on each side of vane 50. Vane 50 extends from port plate 16 to rear plate 18 and is mounted by being attached to one or both of these plates. In the particular embodiment shown in FIGS. 1 and 2, vane 50 is mounted by being fitted into slots in plates 16 and 18. In the direction of rotor rotation vane 50 extends from a final portion of the intake zone of the pump into an initial portion of the compression zone of the pump. The major surfaces 51*a* and 51*b* of vane 50 are substantially parallel to the rotational axis of rotor 20.

Vane 50 reduces turning losses in the pump by reducing turbulence in the portion of the liquid ring where turbulence would otherwise be very high. Vane 50 subdivides the liquid ring as it passes through the sweep of the pump, thereby stabilizing the flow and reducing the amount of turbulence which can occur. Vane 50 also prevents the highest velocity liquid adjacent the periphery 21 of rotor 20 from mixing with the lowest velocity liquid adjacent periphery 15 of the housing. Vane 50 thereby helps to preserve the velocity head of the liquid which can thereby be recovered either as work of compressing the gas being pumped or as mechanical energy through momentum exchange with the rotor when the liquid re-enters the rotor in the compression zone of the pump.

Vane 50 need not be located exactly as shown in FIGS. 1 and 2. For example, the vane could alternatively be located throughout a range of radial locations between the inner periphery 15 of the housing and the outer periphery 21 of the rotor as long as a substantial part (i.e., typically at least 5%, and preferably at least 10%) of the portion of the liquid ring flowing outside rotor periphery 21 passes on each side of the vane. Similarly, the vane need not be exactly concentric with the adjacent portion of housing periphery 15, but may be shaped relative to housing periphery 15 and rotor periphery 21 to provide additional control of the fluid velocities in the liquid ring as discussed in detail below in connection with FIG. 10.

Although only one vane 50 is employed in the particular embodiment shown in FIGS. 1 and 2, it will be understood that two or more radially spaced vanes could be used. For example, in FIG. 3 two approximately concentric vanes 52 and 54 are provided in the sweep of the pump. Except for differences in radial location and in length (in the direction of rotor rotation), each vane 52 and 54 is generally similar to vane 50 in FIGS. 1 and 2. As discussed above, vanes 52 and 54 are both located so that at least a substantial part (i.e., typically at least 5%, and preferably at least 10%) of the portion of the liquid ring outside the outer periphery of the rotor passes on each side of each vane.

Figure 4:
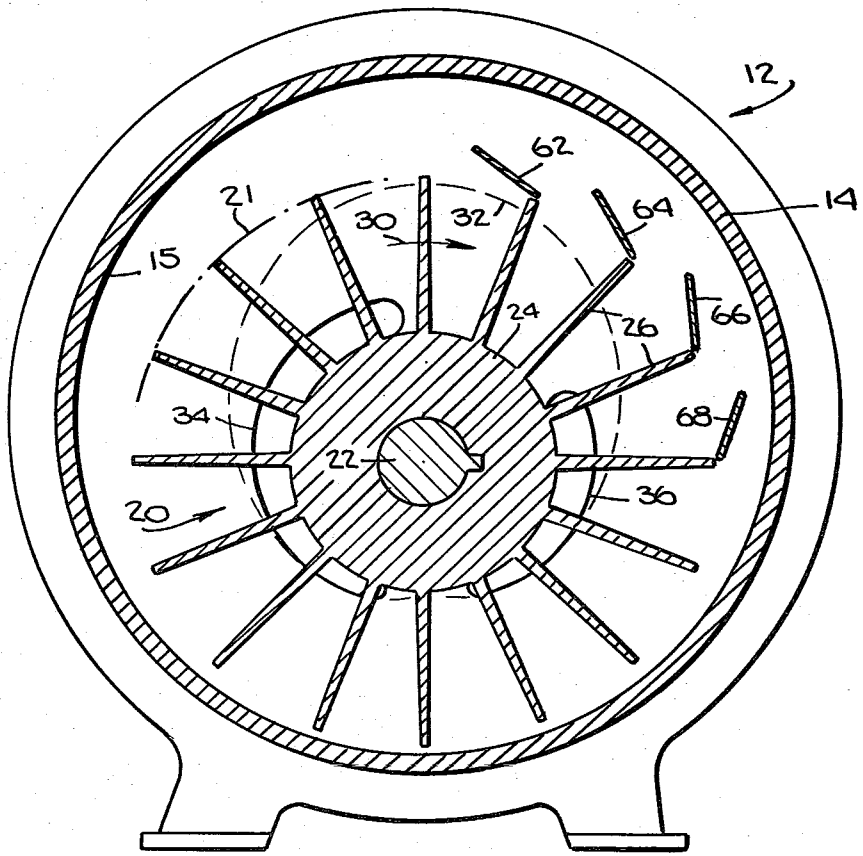
FIGS. 3–10 are views similar to FIG. 1 showing other similar pumps constructed in accordance with the principles of the invention.
Figure 11:
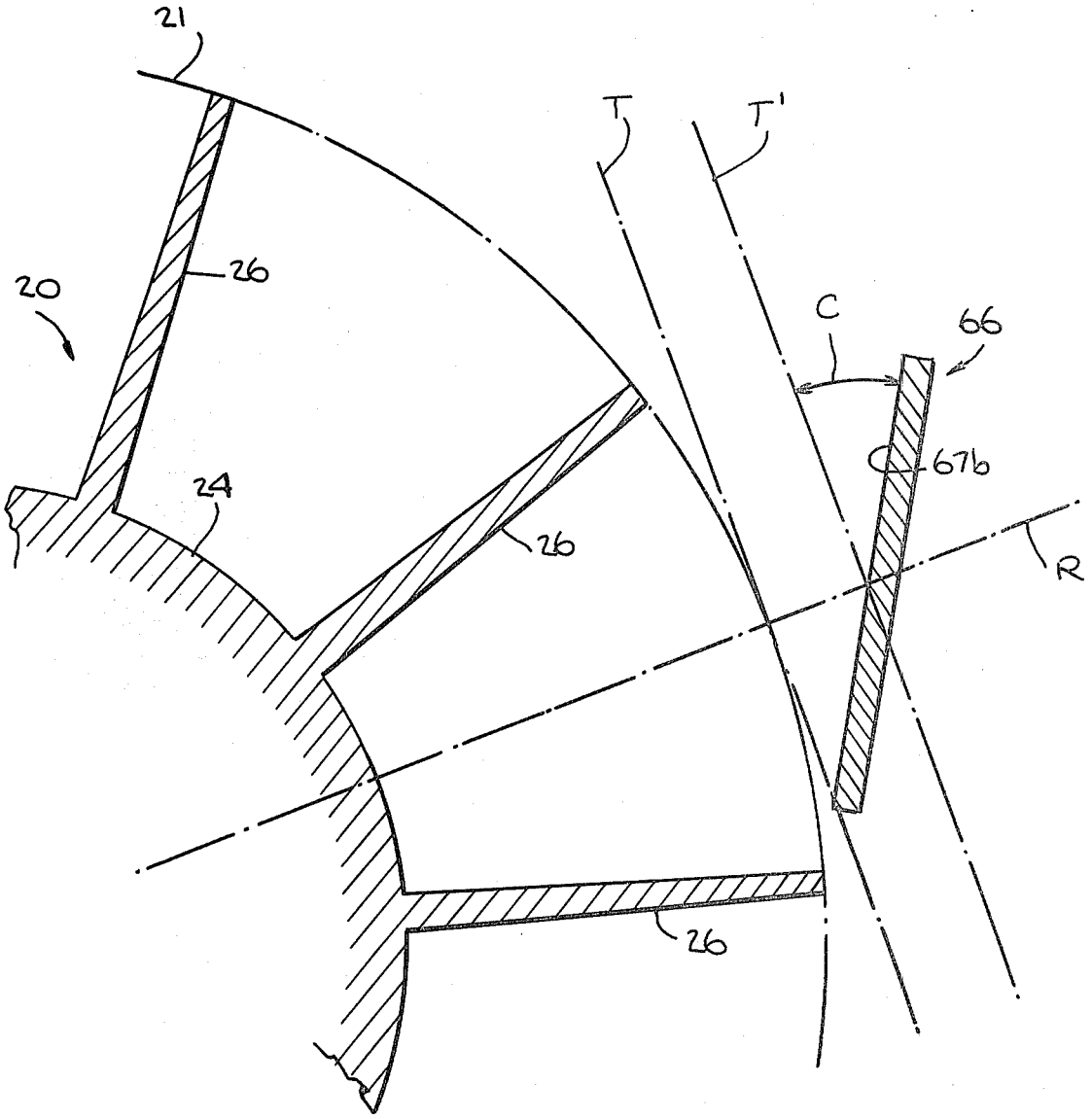
FIG. 11 is an enlarged view of a portion of FIG. 4.

FIG. 4 shows how vanes in the liquid ring can be used in accordance with the present invention to increase the efficiency with which the liquid re-enters the rotor in the compression zone of the pump. As shown in FIG. 4, vanes 62, 64, 66, and 68 are mounted in the liquid ring adjacent the compression zone. The vanes are circumferentially spaced along the periphery 21 of rotor 20, and each vane is angled toward rotor periphery 21 in the direction of rotor rotation. The angles of the vanes relative to rotor periphery 21 are chosen to improve the angle at which the liquid re-enters the rotor, thereby improving the efficiency of that re-entry and reducing the associated shock losses. In general, the angle between each portion of each major surface of each vane and the radially adjacent portion of rotor periphery 21 is less than 45°, preferably less than 35°. This angular relationship is illustrated more clearly in FIG. 11, in which the line R is radial of rotor 20, the line T is tangent to rotor periphery 21 at the intersection of the rotor periphery and line R, and the line T′ is parallel to line T and intersects the inner major surface 67*b* of typical vane 66 where line R intersects that surface. The angle C is then the angle between line T′ and the portion of the inner major surface 67*b* of vane 66 where line R intersects that surface. Angle C is therefore typical of the angles referred to herein as the angle between a portion of the major surface of a vane and the radially adjacent portion of rotor periphery 21. Angle C is generally less than 45°, and preferably less than 35° as mentioned above.

Vanes 62, 64, 66, and 68 are not necessarily substantially flat as shown in FIG. 4, but may alternatively be curved in the direction of rotor rotation.

In addition to improving the angle of liquid re-entry into the rotor as described above, vanes 62, 64, 66, and 68 may cooperate with one another and with other features of the pump such as the inner periphery 15 of housing 14 to alter the velocity of the adjacent liquid so that the liquid re-enters the rotor at more nearly the proper velocity. For example, the liquid re-entering the rotor in the initial portion of the compression zone may require deceleration. This liquid can be decelerated by arranging the vanes adjacent this liquid (e.g., vanes 62 and 64) so that they diverge from one another in the direction of rotor rotation, thereby providing a diffusing channel which decelerates the liquid passing between those vanes with substantially less energy loss than would result from abrupt deceleration of the liquid by the rotor. The liquid re-entering the rotor in the intermediate portion of the compression zone may have approximately the correct velocity for efficient re-entry. Accordingly, the vanes adjacent this liquid (e.g., vanes 64 and 66) may be arranged so that they are substantially parallel to one another and therefore neither accelerate nor decelerate the liquid passing between them. The liquid re-entering the rotor in the final portion of the compression zone may require acceleration. Accordingly, the vanes adjacent this liquid (e.g., vanes 66 and 68) may be arranged so that they converge toward one another in the direction of rotor rotation and thereby act as a nozzle for accelerating the liquid passing between them. Again, this manner of accelerating the liquid is more efficient than abrupt acceleration of the liquid by the rotor. All of these techniques for controlling the velocity of the liquid re-entering the rotor further reduce the shock losses associated with the re-entry of the liquid into the rotor.

Figure 3:
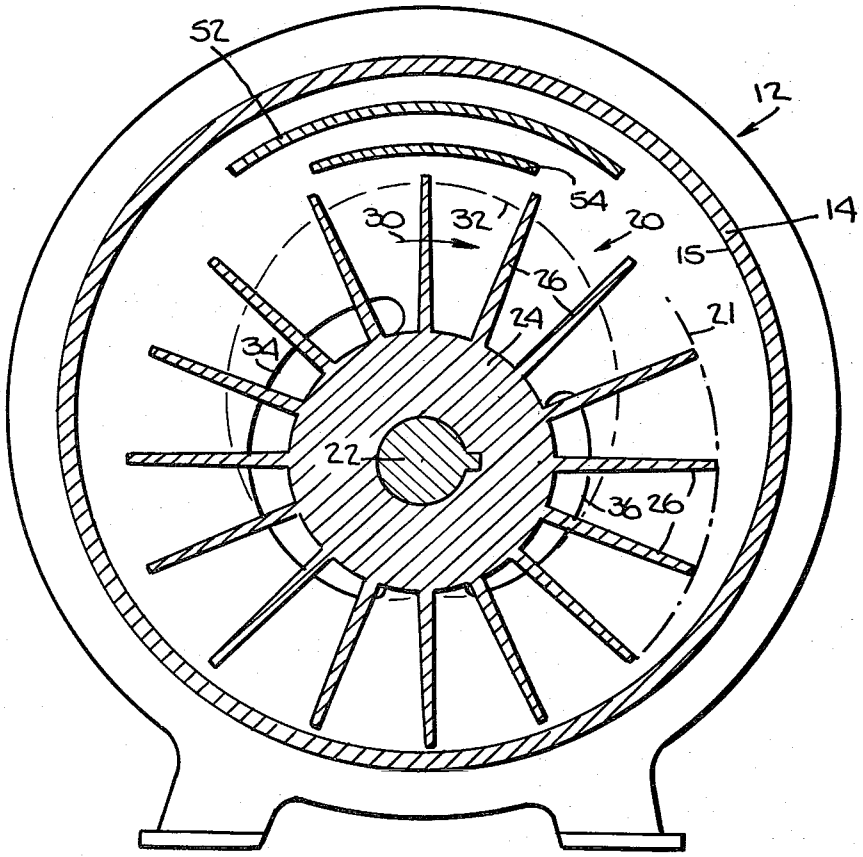

Vanes 62, 64, 66, and 68 in FIG. 4 are generally similar to vanes 50, 52, and 54 in FIGS. 1—3 in that the major surfaces of each vane are substantially parallel to the rotor axis. Also like vanes 50, 52, and 54, each of vanes 62, 64, 66, and 68 extends from port plate 16 to rear plate 18 and is fixedly mounted on one or both of these plates, for example by being seated in slots in these plates in a manner similar to FIG. 2. Alternatively, the effect of one or more of vanes 62, 64, 66, and 68 may be made variable by mounting one or more of these vanes so that it can be pivoted about an axis substantially parallel to the rotational axis of rotor 20. In the embodiment shown in FIG. 5, for example, each of vanes 72, 74, 76, and 78 (which are otherwise similar to vanes 62, 64, 66, and 68 in FIG. 4) is mounted on a respective one of rotatable shafts 82, 84, 86, and 88. All of these shafts are substantially parallel to the rotational axis of rotor 20, and all of the shafts pass through the pump housing to enable them to be rotated from outside the pump to control the inclination of vanes 72, 74, 76, and 78 relative to one another and to rotor periphery 21. In this way the effect of vanes 72, 74, 76, and 78 can be varied to adjust the pump to various operating conditions such as different running speeds or compression ratios.

Figure 5:
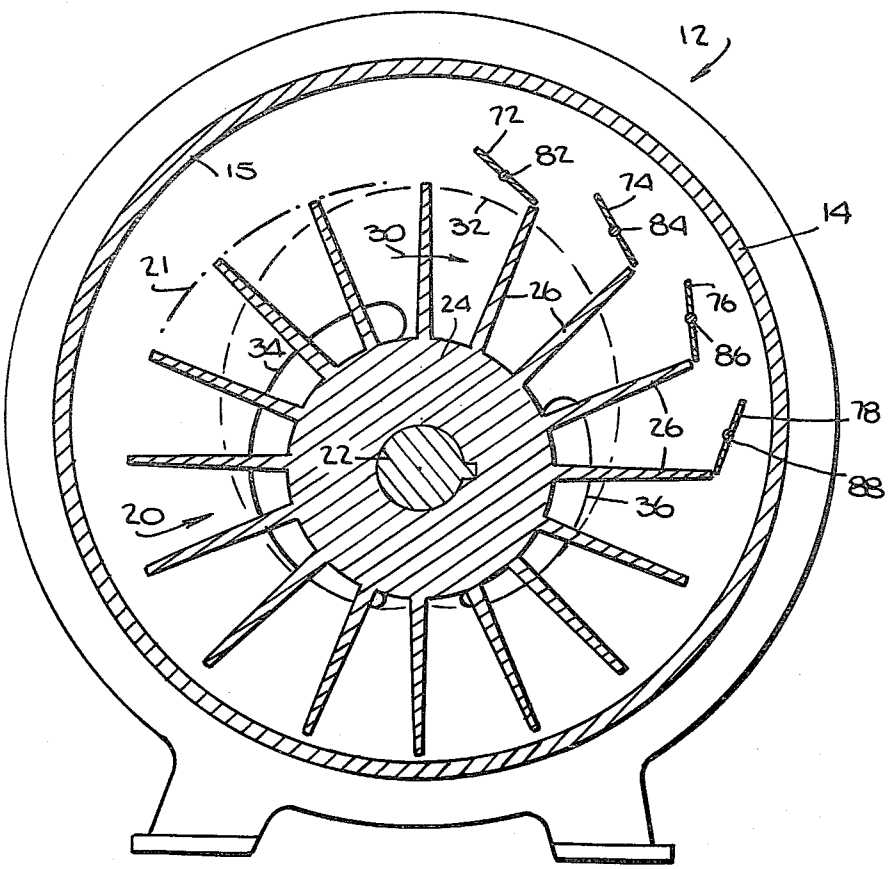

Although four vanes (62, 64, 66, and 68 or 72, 74, 76, and 78) are employed in the particular embodiments shown in FIGS. 4 and 5, it will be understood that any number of such vanes can be used as desired. As in the previously discussed embodiments, each vane is located so that at least a substantial part (i.e., typically at least 5%, and preferably at least 10%) of the portion of the liquid ring outside rotor periphery 21 passes on each side of each vane. If desired, vanes of the type shown in FIGS. 4 and 5 can be used in combination with vanes of the type shown in FIGS. 1–3 to reduce both turning losses and re-entry losses.

Figure 6:
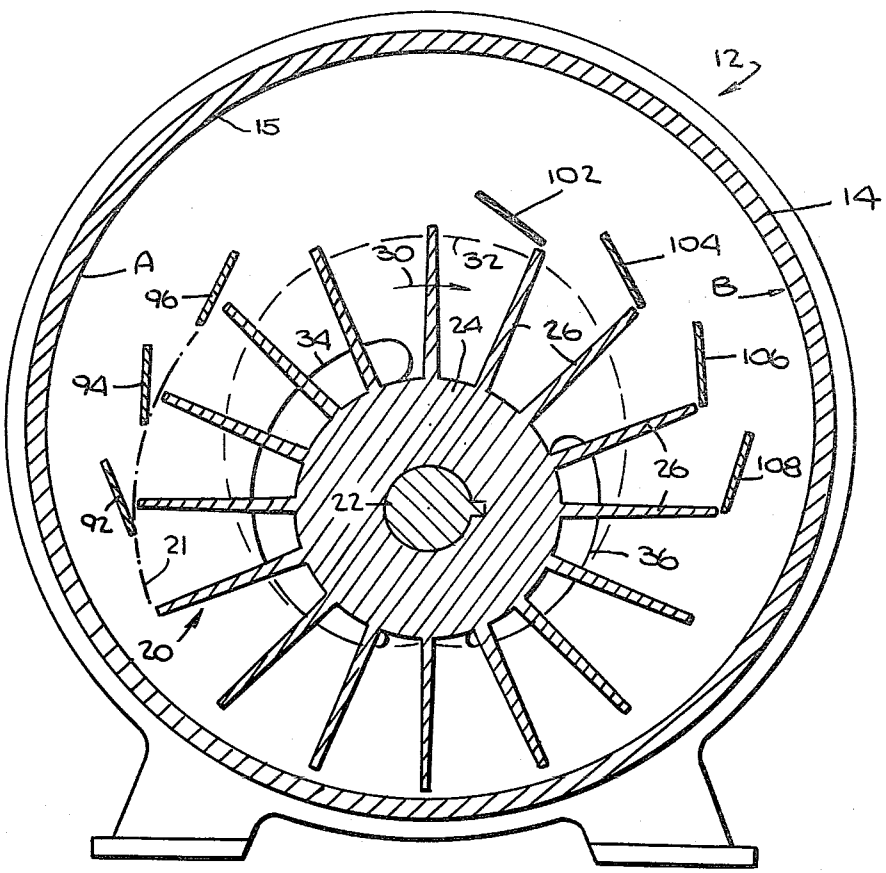

Because liquid energy losses such as turning losses, frictional drag losses, and shock losses are proportional to the square of the velocity of the liquid involved, another approach to reducing these losses in accordance with this invention is to reduce the velocity of the liquid in at least part of the sweep of the pump. This can be accomplished as shown in FIG. 6 by locating one or more vanes 92, 94, and 96 in the liquid ring in the intake zone of the pump in an arrangement which decelerates the liquid exiting from the rotor. Each of vanes 92, 94, and 96 is inclined away from rotor periphery 21 in the direction of rotor rotation, and each vane is also angled away from the adjacent vane or vanes to form a plurality of diffusing passages which act to reduce the velocity of the liquid passing through those passages. The liquid exiting from vanes 92, 94, and 96 therefore passes through the sweep of the pump at lower velocity than would otherwise be the case. Accordingly, turning losses, frictional drag losses, and the like are substantially reduced in the sweep of the pump. After passing through the sweep, the liquid is preferably accelerated again for re-entry into the rotor by vanes 102, 104, 106, and 108, which may be similar, for example, to vanes 62, 64, 66, and 68 in FIG. 4.

As in the case of the other vanes discussed above, the major surfaces of vanes 92, 94, and 96 are all substantially parallel to the rotational axis of rotor 20. In general, the angle between each portion of each major surface of each vane and the radially ajdacent portion of rotor periphery 21 is less than 45°, preferably less than 35°. Vanes 92, 94, and 96 need not be substantially flat as shown in FIG. 6, but may alternatively be curved in the direction of rotor rotation.

Figure 7:
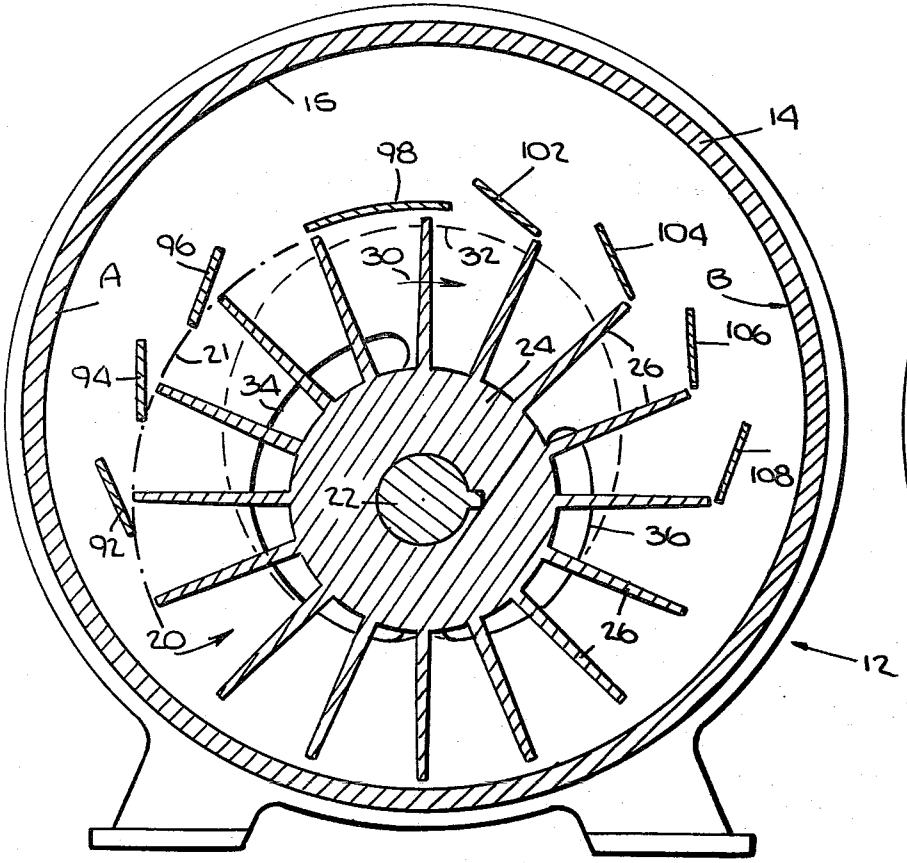

As shown in FIG. 6, in order to permit the reduced velocity liquid to pass through the sweep of the pump without excessive protrusion of the adjacent portion of the inner periphery 32 of the liquid ring inwardly toward rotor hub 24, the inner periphery of the pump housing adjacent the sweep of the pump (i.e., the portion of pump periphery 15 from about point A to point B in the direction of rotor rotation) is farther from rotor periphery 21 than the corresponding portion of the pump periphery in the previously discussed embodiments. This increases the cross sectional area of the reduced velocity portion of the liquid ring, as is desirable to allow that portion of the liquid ring to pass through the sweep of the pump without driving the adjacent portion of the inner periphery 32 of the liquid ring inward toward rotor hub 24. If desired, a stabilizing vane 98 can be provided adjacent to and concentric with rotor periphery 21 between vanes 96 and 102 as shown in FIG. 7 to further help prevent the lower velocity liquid in the sweep of the pump from driving the adjacent portion of liquid ring periphery 32 inward. (The particular stabilizing vane 98 shown in FIG. 7 does not have a substantial part of the portion of the liquid ring outside rotor periphery 21 passing on each side of the vane because it is so close to the rotor periphery. Accordingly, this vane by itself and without other vanes such as vanes 50, 52, 54, 92, 94, 96, 102, 104, 106, 108, etc., would not be an embodiment of the present invention.)

Vanes 92, 94, and 96 in FIGS. 6 and 7 are generally similar to the other fixed vanes described above in that each vane extends from port plate 16 to rear plate 18 and is mounted on one or both of these plates. As with the other vanes of this invention, a substantial part (i.e., typically at least 5%, and preferably at least 10%) of the adjacent portion of the liquid ring outside the rotor passes on each side of each vane.

Figure 8:
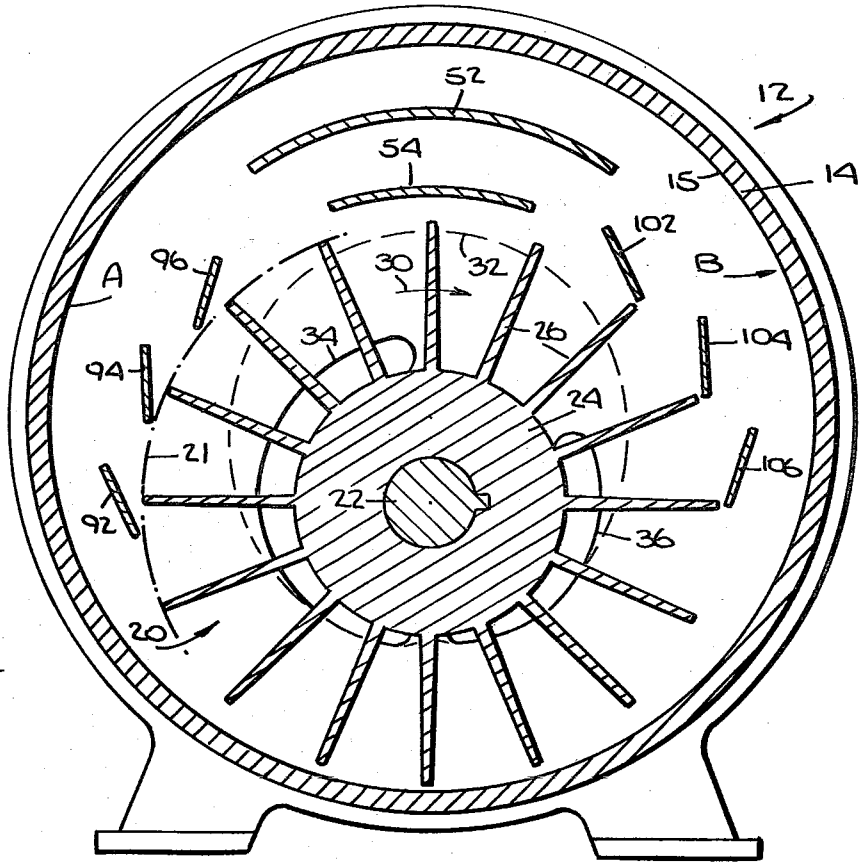

Although three vanes 92, 94, and 96 are employed in the intake zone in the particular embodiments shown in FIGS. 6 and 7, it will be understood that any number of such vanes can be used as desired. It is also possible to advantageously combine an arrangement of vanes of the type shown in FIGS. 6 and 7 with vanes of the type shown in FIGS. 1–3 to still further reduce turning losses. A typical combination of these vane types is shown in FIG. 8. In addition to deceleration vanes 92, 94, and 96, and acceleration vanes 102, 104, and 106, all of which may be similar to the correspondingly numbered vanes in FIG. 6, the embodiment shown in FIG. 8 includes two turning vanes 52 and 54 which may be similar to the correspondingly numbered vanes in FIG. 3.

Figure 9:
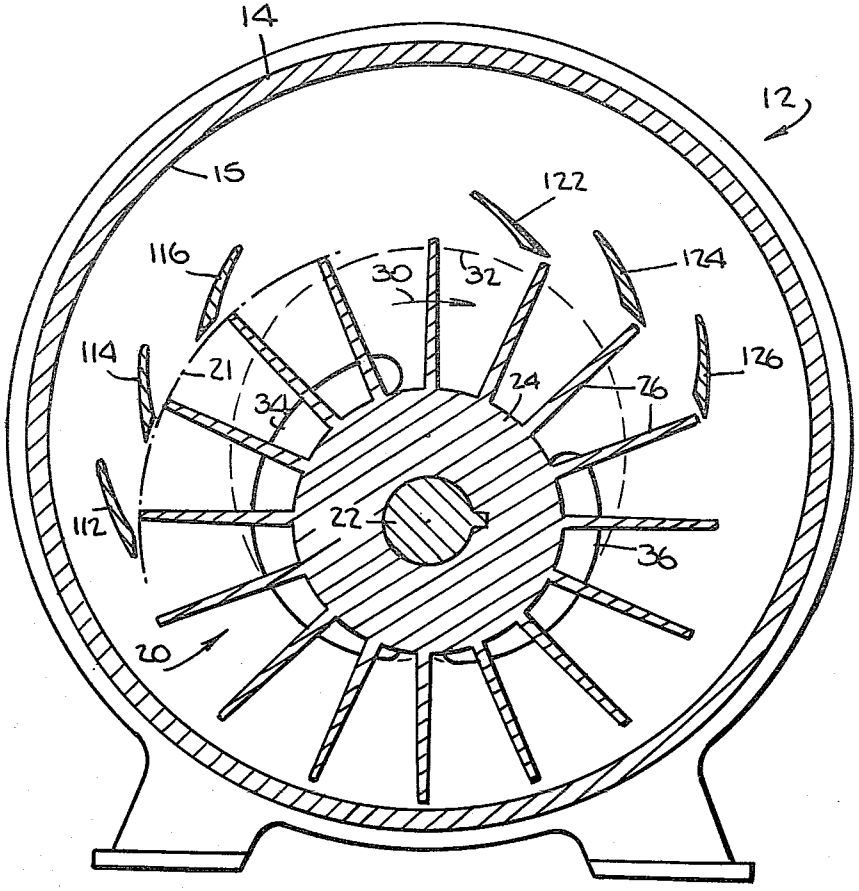

Additional control of the fluid velocities in the portion of the liquid ring outside the rotor periphery can be achieved in accordance with this invention by other means such as using lens-shaped or wedge-shaped vanes. For example, FIG. 9 shows a pump in which fluid decelerating vanes 112, 114, and 116 in the intake zone of the pump decrease in thickness in the direction of rotor rotation to enhance the diffusing action of the vanes. Similarly, fluid accelerating vanes 122, 124, and 126 in the compression zone of the pump increase in thickness in the direction of rotor rotation to increase the nozzle-like effect produced by them. In other respects the embodiment shown in FIG. 9 may be similar to the embodiment shown in FIG. 6.

Figure 10:
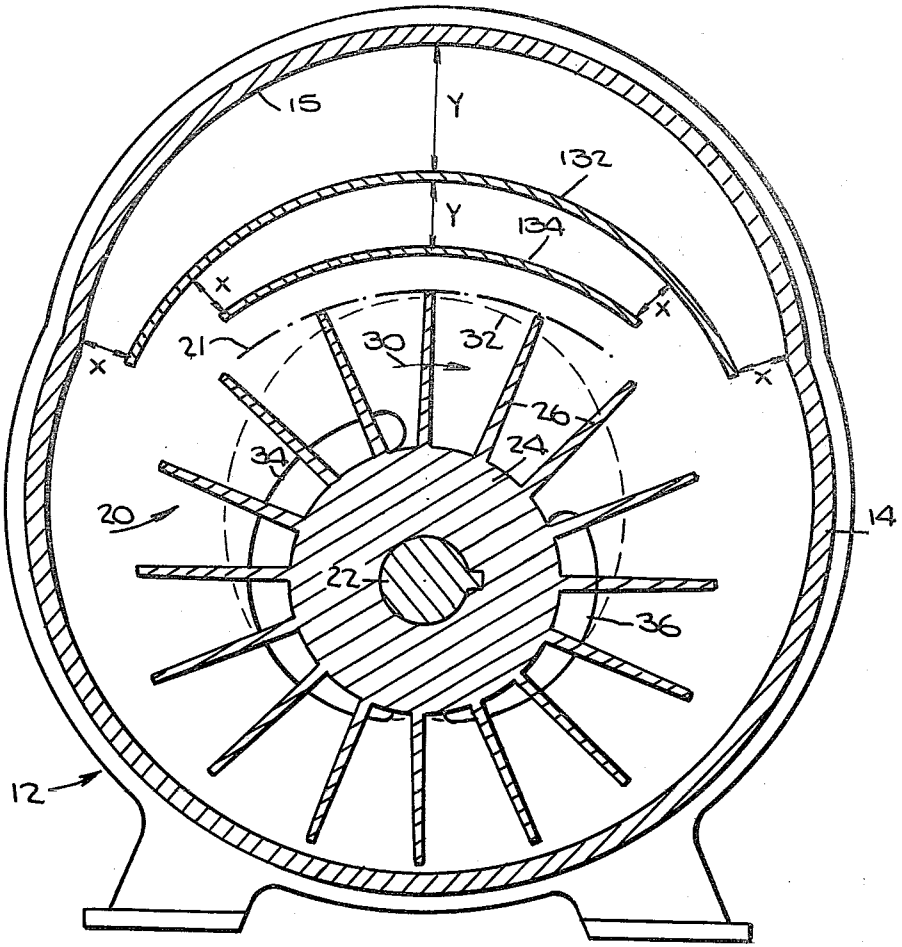

FIG. 10 shows another alternative embodiment in which the spacing among the sweep portion of housing periphery 15 and turning vanes 132 and 134 varies circumferentially of the pump to provide additional control of the velocity of the liquid in the sweep. As in FIGS. 6–9, the sweep portion of housing periphery 15 in the pump of FIG. 10 is farther from rotor periphery 21 than in the other embodiments. Turning vane 132 forms a channel with this portion of housing periphery 15 having approximately equal initial and final radial dimensions X, but having intermediate radial dimension Y greater than X. Accordingly, this channel initially diffuses the liquid passing through it to a lower velocity, and after the liquid has made the turn in the channel at this lower velocity, the channel re-accelerates the liquid back to approximately its initial velocity. Vane 134 is similarly spaced from vane 132 so that the channel defined by those vanes acts in a similar manner on the liquid passing through that channel.

Although the invention has been illustrated in the context of several particular embodiments, it will be understood that the invention is not limited to those embodiments. It will also be understood that various modifications can be implemented by those skilled in the art without departing from the scope and spirit of the invention. For example, the number, placement, and shape of the various types of vanes disclosed herein can be varied as discussed in detail above.

I claim:

1. In a liquid ring pump including an annular housing; a rotor rotatably mounted within the housing so that it is eccentric to at least a portion of the annular housing, the rotor having a plurality of radially extending blades; and a quantity of pumping liquid maintained in the housing so that it is engaged by a portion of each rotor blade at all times during operation of the pump and forms an annular ring around the inner periphery of the housing when the rotor is rotated, the improvement comprising:

at least one vane mounted relative to the housing and disposed in the liquid ring with at least one axis of each major surface of the vane substantially parallel to the rotational axis of the rotor, the vane being located in the liquid ring so that a substantial portion of the liquid in the liquid ring outside the outer periphery of the rotor flows past the vane on each side of the vane at all times during operation of the pump to reduce energy losses due to turbulence in the liquid ring.

2. The apparatus defined in claim 1 wherein at least 5% of the liquid in the portion of the liquid ring outside the outer periphery of the rotor and adjacent to the vane passes on each side of the vane.

3. The apparatus defined in claim 2 wherein the vane extends in the direction of rotor rotation from the portion of the liquid ring in which the inner periphery of the housing diverges from the outer periphery of the rotor in the direction of rotor rotation to the portion of the liquid ring in which the inner periphery of the housing converges toward the outer periphery of the rotor in the direction of rotor rotation.

4. The apparatus defined in claim 3 wherein the vane is approximately concentric with the adjacent portion of the inner periphery of the housing.

5. The apparatus defined in claim 3 wherein the vane forms a channel with the adjacent portion of the inner periphery of the housing, wherein the initial portion of the vane diverges from the adjacent portion of the inner periphery of the housing in the direction of rotor rotation to decelerate the liquid in that portion of the channel, and wherein the final portion of the vane converges toward the adjacent portion of the inner periphery of the housing in the direction of rotor rotation to accelerate the liquid in that portion of the channel.

6. The apparatus defined in claim 1 wherein at least 10% of the liquid in the portion of the liquid ring outside the outer periphery of the rotor and adjacent to the vane passes on each side of the vane.

7. In a liquid ring pump having an annular housing, a rotor rotatably mounted within the housing so that it is eccentric to at least a portion of the annular housing, and a quantity of pumping liquid maintained in the housing so that it forms an annular ring around the inner periphery of the housing when the rotor is rotated, the improvement comprising:

at least one vane mounted relative to the housing and disposed in the portion of the liquid ring in which the inner periphery of the housing converges toward the outer periphery of the rotor in the direction of rotor rotation, the major surfaces of the vane being substantially parallel to the rotational axis of the rotor and the vane converging toward the outer periphery of the rotor in the direction of rotor rotation, the vane being located in the liquid ring so that at least 5% of the liquid in the portion of the liquid ring outside the outer periphery of the rotor and adjacent to the vane passes on each side of the vane.

8. In a liquid ring pump having an annular housing, a rotor rotatably mounted within the housing so that it is eccentric to at least a portion of the annular housing, and a quantity of pumping liquid maintained in the housing so that it forms an annular ring around the inner periphery of the housing when the rotor is rotated, the improvement comprising:

a first plurality of vanes mounted relative to the housing and circumferentially spaced in the portion of the liquid ring in which the inner periphery of the housing converges toward the outer periphery of the rotor in the direction of rotor rotation, the major surfaces of each vane being substantially parallel to the rotational axis of the rotor, and each vane being disposed in the liquid ring so that at least 5% of the liquid in the portion of the liquid ring outside the outer periphery of the rotor and adjacent to the vane passes on each side of the vane, each vane in the first plurality converging toward the outer periphery of the rotor in the direction of rotor rotation, and at least one of the vanes in the first plurality converging toward the adjacent vane or vanes in the direction of rotor rotation.

9. The apparatus defined in claim 8 wherein at least one of the vanes in the first plurality diverges from the adjacent vane or vanes in the direction of rotor rotation.

10. The apparatus defined in claim 8 wherein at least one of the vanes in the first plurality of vanes increases in thickness in the direction of rotor rotation.

11. The apparatus defined in claim 8 wherein there is a second plurality of said vanes circumferentially spaced in the portion of the liquid ring in which the inner periphery of the housing diverges from the outer periphery of the rotor in the direction of rotor rotation, each vane in the second plurality diverging from the outer periphery of the rotor and from the adjacent vane or vanes in the direction of rotor rotation.

12. The apparatus defined in claim 11 wherein at least one of the vanes in the second plurality of vanes decreases in thickness in the direction of rotor rotation.

13. The apparatus defined in claim 11 wherein the inner periphery of the housing in the region from the second plurality of vanes to the first plurality of vanes in the direction of rotor rotation is spaced from the adjacent outer periphery of the rotor so that the adjacent portion of the liquid ring outside the rotor periphery can travel at a lower average velocity than the exit velocity from the rotor without substantially increasing the adjacent portion of the liquid ring inside the rotor periphery.

14. The apparatus defined in claim 11 further comprising a stabilizing vane adjacent to and concentric with a portion of the outer periphery of the rotor intermediate the last vane in the second plurality of vanes in the direction of rotor rotation and the first vane in the first plurality of vanes in the direction of rotor rotation.

15. In a liquid ring pump havng an annular housing, a rotor rotatably mounted within the housing so that it is eccentric to at least a portion of the annular housing, and a quantity of pumping liquid maintained in the housing so that it forms an annular ring around the inner periphery of the housing when the rotor is rotated, the improvement comprising:

at least one vane mounted relative to the housing and disposed in the portion of the liquid ring in which the inner periphery of the housing diverges from the outer periphery of the rotor in the direction of rotor rotation, the major surfaces of the vane being substantially parallel to the rotational axis of the rotor and the vane diverging from the outer periphery of the rotor in the direction of rotor rotation, the vane being located in the liquid ring so that at least 5% of the liquid in the portion of the liquid ring outside the outer periphery of the rotor and adjacent to the vane passes on each side of the vane.

* * * * *